United States Patent [19]

Sage

[11] Patent Number: 4,750,148

[45] Date of Patent: Jun. 7, 1988

[54] OPTICAL GAUSSIAN CONVOLVERS

[75] Inventor: Jay P. Sage, Newton Centre, Mass.

[73] Assignee: The United States of America as represented by the Secretary of the Air Force, Washington, D.C.

[21] Appl. No.: 870,047

[22] Filed: Jun. 3, 1986

[51] Int. Cl.[4] ..... G06G 9/00

[52] U.S. Cl. ..... 364/822; 364/819

[58] Field of Search ..... 364/822, 826, 827, 819, 364/807; 350/162.14, 162.13, 162.12

[56] References Cited

U.S. PATENT DOCUMENTS

| | | | |
|---|---|---|---|
| 3,510,223 | 5/1970 | Lohmann | 356/71 |
| 3,544,197 | 12/1970 | Weaver | 350/162 |
| 3,809,873 | 5/1974 | Klahr | 235/181 |
| 3,947,123 | 3/1976 | Carlson | 350/162.14 |
| 4,023,037 | 5/1977 | Weiss et al. | 250/313 |
| 4,173,720 | 11/1979 | Geluk | 250/445 T |
| 4,282,510 | 8/1981 | Southgate | 340/146.3 F |
| 4,505,544 | 3/1985 | Blodgett | 364/822 |
| 4,514,059 | 4/1985 | McDonnell | 364/822 |
| 4,588,260 | 5/1986 | Horner | 364/822 |
| 4,695,973 | 9/1987 | Yu | 364/822 |

*Primary Examiner*—Michael R. Fleming

*Attorney, Agent, or Firm*—William G. Auton; Donald J. Singer

[57] ABSTRACT

The variable Gaussian convolution of an optical image is performed using a transparency, a focusing lens, a TV camera and a mechanism which moves the camera. The transparency has pattern inscribed on it which diffracts the light of the image with a Gaussian function of radius. The focusing lens receives the diffracted image from the transparency and focuses it. The camera receives the Gaussian convolution of the optical image from the focusing lens by being initially positioned along the optical axis of the lens at the focal length of the lens. As the camera is shifted to variable positions by the mechanism, the size of the Gaussian function increases as the camera is moved towards the lens, and is decreased as the camera is moved away from the lens.

11 Claims, 1 Drawing Sheet

OPTICAL GAUSSIAN CONVOLVERS

STATEMENT OF GOVERNMENT INTEREST

The invention described herein may be manufactured and used by or for the Government for governmental purposes without the payment of any royalty thereon.

BACKGROUND OF THE INVENTION

The present invention relates to non-coherent optical convolvers that process optical images in general convolution functions.

A difference-of-Gaussian's technique is an optical image process which convolves an original image with two separate Gaussian functions and subtracts the results. Present implementation of the difference-of-Gaussian algorithm are carried out on digital computers, and require both extensive hardware and relatively long computational times.

The task of processing optical images in general convolution functions and, more specifically, in a Gaussian convolution, using a direct application of optical elements on an original image, is alleviated to some extent by the following U.S. Patents, which are incorporated herein by reference:

U.S. Pat. No. 3,510,223 issued to A. W. Lohman on May 5, 1970;

U.S. Pat. No. 3,544,197 issued to C. S. Weaver on Dec. 1, 1970;

U.S. Pat. No. 3,809,873 issued to C. N. Klahr on May 7, 1974;

U.S. Pat. No. 4,023,037 issued to H. Weiss on May 10, 1977;

U.S. Pat. No. 4,173,720 issued to R. J. Geluk on Nov. 6, 1979; and

U.S. Pat. No. 4,282,510 issued to P. D. Southgate on Aug. 4, 1981.

The Lohman reference discloses an optical cross-correlation and convolution method wherein a coherent light beam is directed towards a converging lens, with a pair of diffraction gratings that revolve around each other, producing a changing grating interval.

The Weaver patent discloses an optical signal processing method for convolving functions. (A collimated laser beam shines through a pair of transparencies containing the functions to be convoluted).

The klahr patent discloses an optical processor for convolution filtering or optically processing two-dimensional convolution integrals. The apparatus is particularly concerned with processing electrical signals from two-dimensional data arrays such as used in synthetic aperture radar.

The Southgate patent discloses a system for the analysis of an optical sensed field and provides for convolving of spatial two-dimensional fields of intensity. Convolving is performed by a signal processor including detector elements and optical and electronic processors. The apparatus employs a diffused light source, an imaging lens and a Gaussian filter.

The Weiss et al patent discloses a method of decoding three-dimensional images using incoherent light or x-rays. Decoding of the image is effected by shifting between an illumination lens and a point hologram in an incoherent monochromatic converging beam.

The Geluk patent discloses an apparatus for image construction wherein a cross-sectional image is constructed from a plurality of profiles by means of back projection. The apparatus uses analog convolution with two-dimensional or one-dimensional function.

The use of digital computers to produce a Gaussian convolution of an image is an unnecessary complexity. The simplest and most direct approach is to process the image with a suitably designed optical element to optically convolve the original image with the desired Gaussian distribution. Additionally, for the desired application of the Gaussian distribution, there exists the need to smoothly vary the size of the Gaussian function. The present invention is intended to satisfy that need.

SUMMARY OF THE INVENTION

The present invention is a non-coherent optical Gaussian convolver, which receives an original image and optically performs a Gaussian convolution on the image in a Gaussian function whose size can be smoothly varied.

The variable Gaussian convolution of an optical image is performed using: a transparency which has a pattern inscribed thereon which diffracts light with a Gaussian function of radius; a focusing lens; and a camera or similar means which records the convolved image. The transparency is placed between the original image and the focusing lens to provide a spatial variation in the lens transmission. If the camera is initially positioned in the focus plane of the lens, any point from the object plane of the original image appears as a point to the camera. If the camera is shifted towards the lens to a new plane, the point from the object plane appears as a disk of light whose diameter is proportional to the displacement of the camera from the focus plane of the lens.

As mentioned above, the transparency is inscribed with pattern which causes the transparency to diffract light in a Gaussian function of radius. In the present invention, this results in the achievement of a Gaussian convolution of the original image. The size of this Gaussian convolution function is varied smoothly by moving the camera various distances from the focal plane of the lens using a means of adjusting the camera position.

It is a principal object of the present invention to convolve an original image with a desired Gaussian function.

It is another object of the present invention to convolve an image with a Gaussian convolution function whose size can be smoothly varied.

It is another object of the present invention to perform Gaussian convolutions optically, instead of digitally using computers.

These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention is a non-coherent optical Gaussian convolver, which receives an original image and optically performs a Gaussian convolution on the image in a Gaussian function whose size can be smoothly varied.

Figure 1:
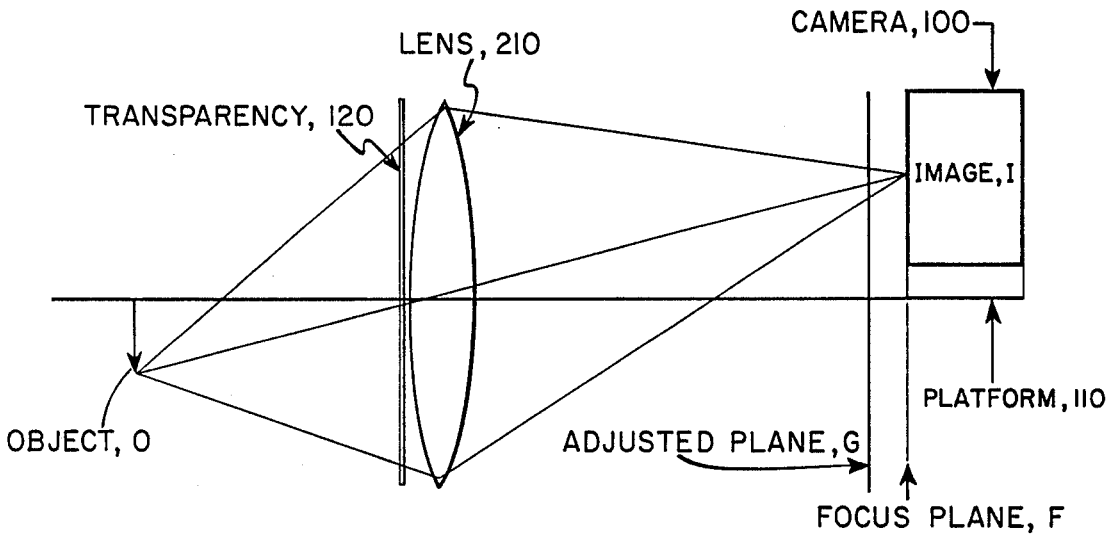
FIG. 1 is a mechanical schematic of an optical convolver based on a defocused lens.

The reader's attention is now directed towards FIG. 1, which is a mechanical schematic of an embodiment of the present invention. In FIG. 1, 'O' is a point in the object plane of the original image, which emits or reflects light. The light of the original image is refracted by the transparency 120, then focused by the lens 210 onto the image point I in the focus plane F.

When the TV camera 100 receives the image I at the focus plane, the image of point O appears as a point. If the camera 100 is shifted to plane G towards the lens 210 by the platform 110, the image of point O is a disk of light whose diameter is proportional to the displacement from the focus plane F. The reason for this is as follows. If the image detector in the camera is in the image plane $$(\text{del-}z=0), \tag{1}$$

then every point in the object maps into a point in the image, and the only effect of the screen is to reduce the effective aperture of the lens.

However, if the image detector is moved out of the image plane, then what used to be a point in the image plane becomes a small replica of the screen scaled by a factor given by:

$$a=(del\text{-}z)/z \tag{2}$$

where z is a vector which is normal to the image plane, and del is the delta or change in this vector.

Thus, the transmissivity pattern of the screen becomes the point-spread-function of the imaging system, and, therefore, the light intensity distribution in the imager plane is the convolution of the normal sharp image with this minified replica of the screen. By varying del-z one can generate convolutions of the object with a range of kernel functions all having the shape of the screen but with varying scale factors. Since the light is only redistributed, the total intensity in the point-spread-function is constant.

When the transparency of FIG. 1 is clear, the disk observed by the camera in place G is uniformly illuminated. However, if the transparency has a pattern, the intensity of light in the image disk is a replica of that pattern. In the present invention, the transparency has a pattern which produces a diffraction of light in a Gaussian function. The product of this pattern is a Gaussian convolution of the original image. Furthermore, the size of the Gaussian function can be varied smoothly by moving the camera various distances from the focal plane F.

The process of fabricating transparencies is a procedure well known in the art. In the present invention, the transparency is produced by exposing photographic film to the desired Gaussian function. The Weaver reference teaches the use of single frames 35 millimeter film which may possess a variety of diffraction patterns for use as convolution functions using the above-described fabrication process. However, the convolution product produced by the two transparencies of the Weaver reference is a static and unchanging function. The convolution product of the present invention is a variable Gaussian function, whose size can be smoothly adjusted as the mobile platform 110, or a similar means, moves the camera various distances from the focal plane F.

As mentioned above, the platform 110 depicted in FIG. 1 is a schematic representation of a means of moving the camera away from the focal plane F towards or away from the focusing lens 210. A variety of substitutes, too numerous to mention, exist to either manually or via an electrical motor, move the camera, including the hands of the user of the present invention. Only small motions are required (typically in millimeters) but it is preferred that the position be adjusted in less than the frame time of the TV camera. Stepping motors and piezoelectric positioners are instruments known in the art that would be a suitable means for moving the camera.

The single lens 210 depicted in FIG. 1 is just one of many means of focusing the image. Note that if a single lens is used, the image is inverted in the focus plane by the lens.

While the preferred use of the invention of FIG. 1 is to variably convolve a Gaussian function with an original image, the pattern on the transparency may be any function that is: not imaginary, positive, and space limited (e.g., not a function with limits approaching infinity). However, the goal of the present invention was to instantaneously convolve an image optically using a single screen with a transmissivity which is a truncated Gaussian function, and the apparatus of FIG. 1 accomplishes that goal when the pattern on the transparency is the desired Gaussian function.

One final observation on FIG. 1 is that the optimum distance of the transparency from the lens is f, where f equals the focal length of the lens.

Figure 2:
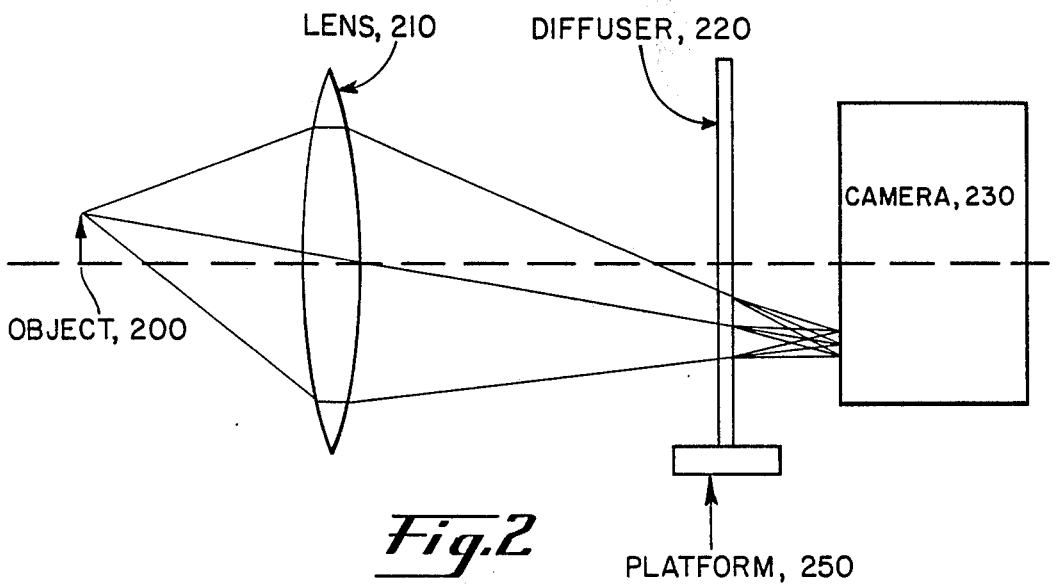
FIG. 2 is a mechanical schematic of an optical convolver based on a diffuser screen.

The reader's attention is now directed towards FIG. 2, which is a mechanical schematic of a second embodiment of the present invention. The embodiment of FIG. 2, is a Gaussian convolver based on a diffuser screen. As in FIG. 1, a point in the object place emits or reflects light that is focused by the lens 210 onto an image point in a focus plane. The camera 230 is initially positioned to receive the image of focused light from the lens in the focus plane. However, between the lens 210 and the camera 230 in FIG. 2 is a diffuser screen 220. The diffuser screen 220 is an optical element designed so that light entering it is scattered into a bundle of rays, whose relative angles are distributed in a Gaussian pattern. The size of the Gaussian pattern is proportional to the distance between the diffuser 220 and the image plane.

The diffuser screen typically includes a medium composed of a solid refractive volume, such as a pane of glass. Suspended throughout the volume of the medium is a plurality of weak scatterers, which might consist of small spheres of nearly index-matched material. Each scatterer is capable of changing the direction of a ray of light by a small amount. A parallel bundle of light rays, after passing through many of these scatterers, will be diffused into a bundle of rays whose directions of travel are spread into a Gaussian pattern. Each ray passes through many of the scatterers, thereby contributing additional quasi-random changes in direction.

This diffuser screen uses a medium which contains a large number of weak (narrow-angle) scatterers. When weak (narrow-angle) scatterers are used, the physical size of the individual spheres which form the scatterers should be large (greater than) compared to the optical wavelengths of light being diffracted.

Using the above guidelines, light entering the middle of a scatterer on the diffuser screen exits relatively unbent. Light which is slightly off-center of a scatterer on the diffuser screen is lightly bent; and light entering around the perimeter of a scatterer is widely bent. These scatterers are suspended throughout the diffuser screen. Note that the screen is uniform and each ray strikes one of many small-angle scatterers. The result is, light from the lens which enters the diffuser screen, exits with scattering angles which are automatically Gaussian in distribution.

As mentioned above, the size of the Gaussian pattern produced by the diffuser screen 220 on the camera 230 is proportional to the distance between the diffuser screen 220 and the image plane. Therefore, the invention of FIG. 2 includes a means of moving the diffuser screen 220 variable distances from the camera 230 in the form of a mobile platform 250, which is similar in nature to the platform 110 of FIG. 1. As with the platform of FIG. 1, a variety of means, including the hands of the user of the invention, may be used to move the diffuser screen various distances away from the camera 230, with the understanding that the size of the Gaussian pattern increases in proportion with increased distances between the diffuser screen 220 and the camera 230.

Two limitations of the optical convolution technique should be kept in mind. The first is since the Gaussian filtering is done before image detection, noise generated in the camera is not filtered as it is in a post-detection convolver. Second, since only one convolution is carried out at a time, the scene under study must not move significantly (on the order of the Gaussian widths) in the time necessary to record the two convolved images.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. An optical convolver which receives an optical image and convolves said image with a function to produce a convolved image such that the size of the function convolved with the image can be varied, said optical convolver comprising:

a transparency which has on its surface a pattern which has an opacity and transparency which is equivalent to said function, said transparency receiving the image and outputting a refracted image with a spatial variation equivalent to said function when it is superimposed onto said image;

a focusing means which receives said refracted image from said transparency, and produces said convolved image by focusing the refracted image onto a focus plane;

a camera which is initially positioned in said focus plane and receives said convolved image from said focusing means with the size of the function convolved with the image increasing when said camera is moved a distance away from the focus plane towards said lens; and a means for moving the camera to variable positions from said focus plane along an optical axis of the focusing means, said variable positions including positions between said focus plane and said focusing means.

2. An optical convolver, as defined in claim 1, wherein said transparency comprises:

a single frame of film which has been exposed to a desired Gaussian function and then developed so that said single frame of film produces said refracted image by imposing said desired Gaussian function on said image, and said desired Gaussian function is varied in size by movements of said camera by said moving means along the optical axis of the focusing means.

3. An optical convolver, as defined in claim 2, wherein the size of the Gaussian function convolved with the image in the refracted image is proportional to the distance between the camera and the focus plane, said size increasing as the camera is moved towards the focusing means, and decreasing as the camera is moved away from the focusing means.

4. An optical convolver, as defined in claim 3, wherein said transparency is placed a distance of f in front of said focusing means, where f comprises the focal length of the focusing means.

5. An optical convolver, as defined in claim 4, wherein said means for moving the camera comprises a piezoelectric positioner which is connected to the camera and is capable of positioning the camera to said variable positions at speeds which are less than a frame time of said camera.

6. An optical convolver, as defined in claim 4, wherein said means for moving the camera comprises a stepping motor which is connected to the camera and is capable of positioning the camera to said variable positions at speeds which are less than a frame time of said camera.

7. An optical convolver which receives an optical image and convolves said image with a Gaussian function to produce a convolved image, such that the size of the Gaussian function convolved with the image can be varied, said optical convolver comprising:

a focusing means which produces a focused output by receiving and focusing said image;

a diffuser screen which receives said focused output and produces said convolved image by scattering all light of said image into a bundle of rays whose relative angles are distributed in a Gaussian pattern;

a camera which receives said convolved image from said diffuser screen said camera being positioned along an optical axis of said focusing means at a distance of about f where f equals the focal length of said focusing means; and a means for moving said diffuser screen to variable positions between said camera and said focusing means, said moving means thereby increasing the size of said Gaussian function as it moves said diffuser screen towards the focusing means, and said moving means decreasing the size of the Gaussian function as it moves said diffuser screen away from said focusing means.

8. An optical convolver, as defined in claim 7, wherein said diffuser screen comprises:

a medium which has a first index of refraction; and a plurality of scatterers suspended throughout said medium, each of said plurality of scatterers being a small sphere composed of material having a second index of refraction which nearly matches the first index of refraction of said medium, said plurality of scatterers being disposed on said medium in a pattern which causes light from said focused output to be relatively unbent at said diffuser screen's center, said pattern causing light of said focused output near the center of each scatterer to be slightly bent, and said pattern causing light of said focused output which is near each scatterer's perimeter to be widely bent, said plurality of scatterers thereby distributing the light of said focused output in said Gaussian pattern.

9. An optical convolver, as defined in claim 8, wherein said medium comprises a pane of glass, and said plurality of scatterers include a large number of said small spheres whose second index of refraction is relatively weak producing a narrow angle of diffraction, said small spheres each having a physical size which is large compared to optical wavelengths of said light of said focused image.

10. An optical convolver, as defined in claim 8, wherein said means for moving said diffuser screen comprises:

a piezoelectric positioner which is connected to said diffuser screen and is capable of positioning it to said variable positions at speeds which are less than a frame time of said camera.

11. An optical convolver, as defined in claim 10, wherein said means for moving said diffuser screen comprises a stepping motor which is connected to said diffuser screen and is capable of positioning it to said variable positions at speeds which are less than a frame time of said camera.

* * * * *